US005185987A

United States Patent [19]

Turvey et al.

[11] Patent Number: 5,185,987

[45] Date of Patent: Feb. 16, 1993

[54] APPARATUS FOR TRANSFERRING STACKS OF FLEXIBLE PRODUCTS

[75] Inventors: Robert R. Turvey, Saginaw; Jeffrey S. Hoffman, Linwood; Robert J. Nestle, Essexville, all of Mich.

[73] Assignee: Dowbrands Inc, Indianapolis, Ind.

[21] Appl. No.: 786,861

[22] Filed: Nov. 1, 1991

[51] Int. Cl.[5] ..... B31B 23/16; B65B 25/14; B65B 63/04

[52] U.S. Cl. ..... 53/429; 53/120; 269/153; 493/204

[58] Field of Search ..... 53/429, 116, 117, 120; 493/204, 254, 449, 446, 455; 198/468.8, 468.3, 468.2; 269/153, 239, 237, 91, 93

[56] References Cited

U.S. PATENT DOCUMENTS

| | | | |
|---|---|---|---|
| 1,211,489 | 1/1917 | Petrocchi | 493/449 X |
| 2,998,247 | 8/1961 | McCloskey | 269/153 X |
| 3,176,973 | 4/1965 | Daniels | 269/153 |
| 3,211,447 | 10/1965 | Kaase et al. | 269/153 |
| 3,963,548 | 6/1976 | George et al. | 493/446 X |
| 4,284,301 | 8/1981 | Geiger et al. | 294/104 |
| 4,588,070 | 5/1986 | Smith | 198/468.3 |
| 4,607,473 | 8/1986 | Ehlus et al. | 53/120 X |
| 4,647,031 | 3/1987 | Smith et al. | 271/82 |
| 4,976,673 | 12/1990 | Smith et al. | 493/194 |
| 5,011,001 | 4/1991 | Cameron | 198/468.2 |
| 5,014,978 | 5/1991 | Smith et al. | 271/308 |

*Primary Examiner*—James F. Coan

[57] ABSTRACT

An apparatus for transferring stacks of flexible products is disclosed including a flat plate base support structure having a top and bottom; at least a first pair of clamping means releasably attached to the top of the support structure for clamping a first stack of flexible products; and an actuating means releasably attached to said first pair of clamping means; said actuating means adapted for substantially simultaneously actuating the at least first pair of clamping means.

14 Claims, 6 Drawing Sheets

APPARATUS FOR TRANSFERRING STACKS OF FLEXIBLE PRODUCTS

BACKGROUND OF THE INVENTION

This invention relates to an apparatus for transferring stacks of flexible products from one elevation to another while creating a fold in the stack. More particularly, the apparatus of the present invention is useful for transferring stacks of flexible products such as bags within a bag sealer.

The machinery used for the production of individual flexible web products such as plastic containers and bags is well known in the art. U.S. Pat. Nos. 4,976,673 and 5,014,978, for example, disclose the type of equipment that is used for producing individual flexible bags. Generally, the machinery includes a large diameter rotating drum which contains multiple heated wire severing and sealing elements positioned in grooves located within the outer periphery of the drum for severing and sealing a continuous web of thermoplastic material which has been folded upon itself to form two plies. The individual bags, are formed by severing portions of the thermoplastic material. The severed areas become side seams for the bags and are typically sealed at the same time as they are severed by the use of the heated wire elements. The individual bags are retained on the drum by a vacuum arrangement as the drum rotates.

The individual bags formed on the large rotating drum are taken from the drum by a smaller transfer drum, also suitably equipped with vacuum. The vacuum on the bags on the large drum is relieved at an appropriate point, and the bags fall onto the smaller drum where the bags are held in position by vacuum. At an appropriate point, the vacuum is released and the individual bags are pulled off the smaller drum by an orbital packer or similar device.

The orbital packing device is provided with a set of packer fingers which move in a circular path in precise timing with the smaller drum so that the fingers remove successive bags, which are typically separated on the drum approximately a nominal ⅛ inch (0.003 m) from each other, from the smaller drum and stack the bags horizontally on a stacking or delivery table against a backstop.

At a precise time, count fingers pivot between a first position which is completely out of the stream of bags into a position between bags to separate the stack of bags into the desired count. The delivery table may be lowered to permit a first clamp assembly to clamp the stack of bags and transfer the stack to further conventional equipment for packaging the bags.

The first clamp assembly may be, for example, a horizontal transfer apparatus including a set of clamping jaws for grasping the stack of bags as described in U.S. Pat. Nos. 4,284,301 and 4,588,070. The horizontal transfer apparatus is used to transfer, in a horizontal alignment, the stack of bags to the surface of a support platform where the stack of bags are laid on the top surface of the support platform for further handling.

Once the stack of bags is delivered to the support platform, the stack of bags is usually at a position directly above a dispenser loading station and a second clamping assembly. The second clamping assembly is raised up to the stack of bags by a cam actuated elevator plate, and then the stack of bags is clamped with a pair of bag clamp fingers which grip the stack at its approximate centerline. Then the cam actuated elevator plate, to which said bag clamp fingers are mounted, lowers the stack from the support platform through a pair of folding guides which places a first fold into the stack (generally, the stack is folded in half) as the stack moves down to a position just below the guides.

The guides restrain the stack until an awaiting turret assembly positions a turret clamp having a pair of clamping jaws which clamp the bottom of the folded stack, wherein the bag clamp fingers on the second clamping assembly are released. The turret assembly begins to index 180 degrees from its dwell position. As the turret assembly indexes, the once-folded stack of bags receives a second fold as the clamped stack of bags passes a folding guide or shroud. The shroud maintains the second fold until the turret assembly stops rotating. The turret clamps are then lowered into an awaiting dispenser, via a cam actuated carton load mechanism, at a position below the turret clamps. The final orientation of the bags in the dispenser is in the form of a twice-folded stack.

The above conventional machinery as a whole, sometimes referred to a "bag sealer apparatus", is well known in the art such as one designed and built by Paper Converting Machine Company (PCMC). The second clamping assembly or cam actuated elevator plate, to which bag clamp fingers are mounted, discussed above, currently used in a bag sealer apparatus is sometimes referred to as a "first fold bag clamping apparatus" which is used for transferring stacks of flexible products from one elevation to another, in vertical alignment, while creating a fold in the stack.

The current first fold bag clamping apparatus uses four separate air actuated devices to operate four separate clamp fingers; the use of four separate actuators has its drawbacks. Using the current first fold bag clamping apparatus, when one actuator fails the whole bag producing and packaging system described above has to be shut down to fix the actuator that fails. Sometimes, the separate actuators used do not actuate simultaneously which also necessitates a shut down of the whole system to correct this malfunction. Furthermore, when one of the actuators does not allow a clamping finger to clamp the stack of bags with an adequate amount of force, again, the entire system must be shut down to adjust the actuator accordingly. When the separate sets of clamping mechanisms do not actuate simultaneously or adequately to clamp the stack of bags, jamming is not uncommon in prior art devices. Such jamming also results in shutting down the apparatus and bag making process entirely.

With prior art devices, there is an average of about 5 failures per bag sealer a month related to the actuators of prior art devices; and rebuild time (fixing time) for the actuators is normally about 2 hours, thus there is a need for a first fold bag clamping apparatus which operates with less failures and less maintenance.

To overcome the above-mentioned disadvantages of the prior art first fold bag clamping apparatuses, it is desired to provide an improved and less complicated first fold bag clamping apparatus.

SUMMARY OF THE INVENTION

One aspect of the present invention is directed to an apparatus for transferring stacks of flexible products including a flat plate base support structure having a top and bottom; at least a first pair of clamping means releasably attached to the top of the support structure for clamping a first stack of flexible products; and an actuating means releasably attached to said first pair of clamping means; said actuating means adapted for substantially simultaneously actuating at least the first pair of clamping means.

A preferred embodiment of the present invention apparatus includes a second pair of clamping means releasably attached to the top of the support structure for clamping a second stack of flexible products and the actuating means is releasably attached to the first and second pair of clamping means such that when said actuating means is activated the first and second pair of clamping means are substantially simultaneously actuated for clamping substantially simultaneously said first and second stacks of flexible products.

Another aspect of the present invention is directed to a folding and packaging assembly for flexible products comprising:

(a) a means for delivering a stack of flexible products to an apparatus for transferring stacks of flexible products;

(b) an apparatus for transferring stacks of flexible products comprising a flat plate base support structure having a top and bottom; at least a first pair of clamping means releasably attached to the top of the support structure for clamping a first stack of flexible products; and an actuating means releasably attached to said first pair of clamping means; said actuating means adapted for substantially simultaneously actuating the at least first pair of clamping means;

(c) a means for transferring the apparatus of (b) with the stack of flexible products to a folding means;

(d) a folding means for folding said stack of flexible products; and (e) a means for packaging the folded stack of flexible products.

Still another aspect of the present invention is directed to a bag sealer apparatus comprising:

(a) a rotary drum for producing individual flexible products;

(b) a transfer drum for transferring the individual flexible products to a transfer point;

(c) a means for removing individual flexible products from the transfer drum;

(d) a means for stacking said individual flexible products at a transfer point;

(e) a means for delivering said stack of flexible products from said transfer point to an apparatus for transferring stacks of flexible products;

(f) an apparatus for transferring stacks of flexible products comprising a flat plate base support structure having a top and bottom; at least a first pair of clamping means releasably attached to the top of the support structure for clamping a first stack of flexible products; and an actuating means releasably attached to said first pair of clamping means; said actuating means adapted for substantially simultaneously actuating the at least first pair of clamping means;

(g) a means for transferring the stack of flexible products to a folding means;

(h) a folding means; and (i) a means for packaging the folded stack of flexible products.

Yet another aspect of the present invention is directed to a process for sequential handling of a stack of flexible products comprising:

(a) removing individual flexible products from a transfer drum;

(b) stacking said individual flexible products at a transfer point;

(c) delivering said stack of flexible products to an apparatus for transferring stacks of flexible products comprising a flat plate base support structure having a top and bottom; at least a first pair of clamping means releasably attached to the top of the support structure for clamping a first stack of flexible products; and an actuating means releasably attached to said first pair of clamping means; said actuating means adapted for substantially simultaneously actuating the at least first pair of clamping means;

(d) transferring the stack of flexible products to a folding means;

(e) folding said stack of flexible products; and (f) packaging the folded stack of flexible products.

The present invention is unique from previous first fold bag clamping apparatuses in that the present invention uses only one single actuating means in performing its function of clamping and transferring a stack of flexible products. The present invention first fold bag clamping apparatus, designed with one actuated device, is more reliable because the apparatus contains fewer moving parts; and fewer moving parts reduces maintenance and maintenance time.

With the use of the present invention, within a six-month period the following benefits, for example, were observed:

(1)about 35 percent reduction in outfeed jams within the bag sealer;

(2)about 15 percent reduction in product rejected in packaging area;

(3)a gain of about 30.5 production hours per year; and (4)a reduction of about six hours of maintenance time per machine per week.

The apparatus of the present invention advantageously uses only one actuator to operate as many as four clamping fingers. The present invention is preferably used to operate two opposing banks of two fingers on an elevator platform. The apparatus of the present invention advantageously achieves the same operational function as prior art first fold bag clamping apparatuses utilizing four separate actuators.

Another advantage of the design of the apparatus of the present invention is that an adjustment on the actuator stroke length, for example using a turn buckle on a piston-like actuator, adjusts all four clamp fingers equally. Thus, the amount of clamping force applied by the clamping fingers to a stack of bags can be adjusted, as desired, depending on the number of bags per stack.

Also, the design of the apparatus of the present invention is more flexible because the same apparatus of the present invention can be used on different bag sealers producing different product sizes. The existing conventional bag sealers can also be retrofitted with the present invention apparatus.

The design of the apparatus of the present invention also preferably employs an actuated device which is not fixed to a stationary surface, for example, neither the cylinder body nor the shaft of a piston-type actuated device is stationary. During actuation, this piston-type actuated device produces the same force in two opposing directions simultaneously. Thus, a non-fixed piston-type actuated device eliminates the need for two or more piston-type devices attached to a stationary surface.

The installation of the present apparatus in a flexible packaging folding assembly provides a considerable improvement in product handling and a reduced number of product jams within a bag sealer apparatus.

The present invention may be better understood by reference to the following detailed description taken in connection with the accompanying drawings in which like reference characters refer to like elements in the several views.

DETAILED DESCRIPTION OF THE PREFERRED EMBODIMENTS

Figure 1:
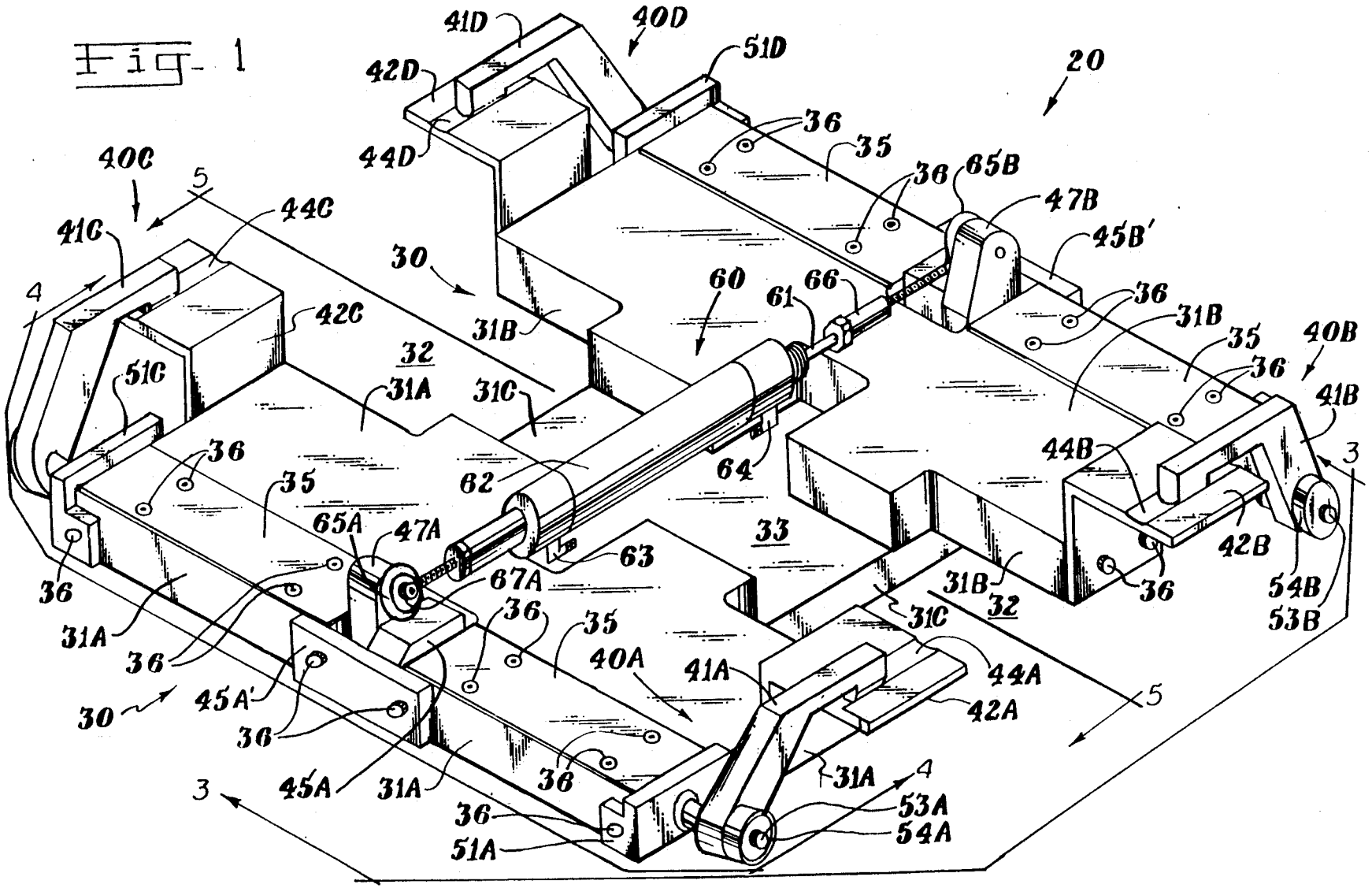
FIG. 1 shows a perspective view of the first fold clamping apparatus of the present invention.

Referring to FIGS. 1–5, there is shown an apparatus 20 for transferring and folding a stack of flexible products such as zippered-type plastic bags 21 (shown in FIGS. 2, 10 and 11 *a–d*), the apparatus 20 including a horizontally positioned support platform in the form of a substantially flat base plate member, generally indicated as numeral 30; clamping assembly means, generally indicated as numerals 40A–D, for clamping a stack of flexible products 21; and an actuating means, generally indicated as numeral 60, for actuating, i.e., opening and closing the clamping means 40A–D

As described and illustrated herein, the present invention is directed to an apparatus 20 which is particularly useful in present commercial equipment, that is, bag sealer apparatuses which are designed to produce side-by-side pairs of stacks of bags simultaneously and to package those pairs of stacked bags with separate pieces of packaging equipment. Accordingly, the present invention will be described herein as one designed to handle a pair of stacks of bags utilizing a first and second pair of clamping assemblies (for a total of four individual clamping assemblies), i.e., a pair of clamping assemblies for each stack of bags. However, it is understood that the scope of the present invention is not limited to any one embodiment described herein, but covers embodiments wherein only one stack of bags is being processed and only one pair of clamping means is being utilized to handle a single stack of bags. Such minor modifications and variations in designs to the present invention are well within the capabilities of those skilled in the art and are intended to be covered by the scope of the present invention.

Figure 2:
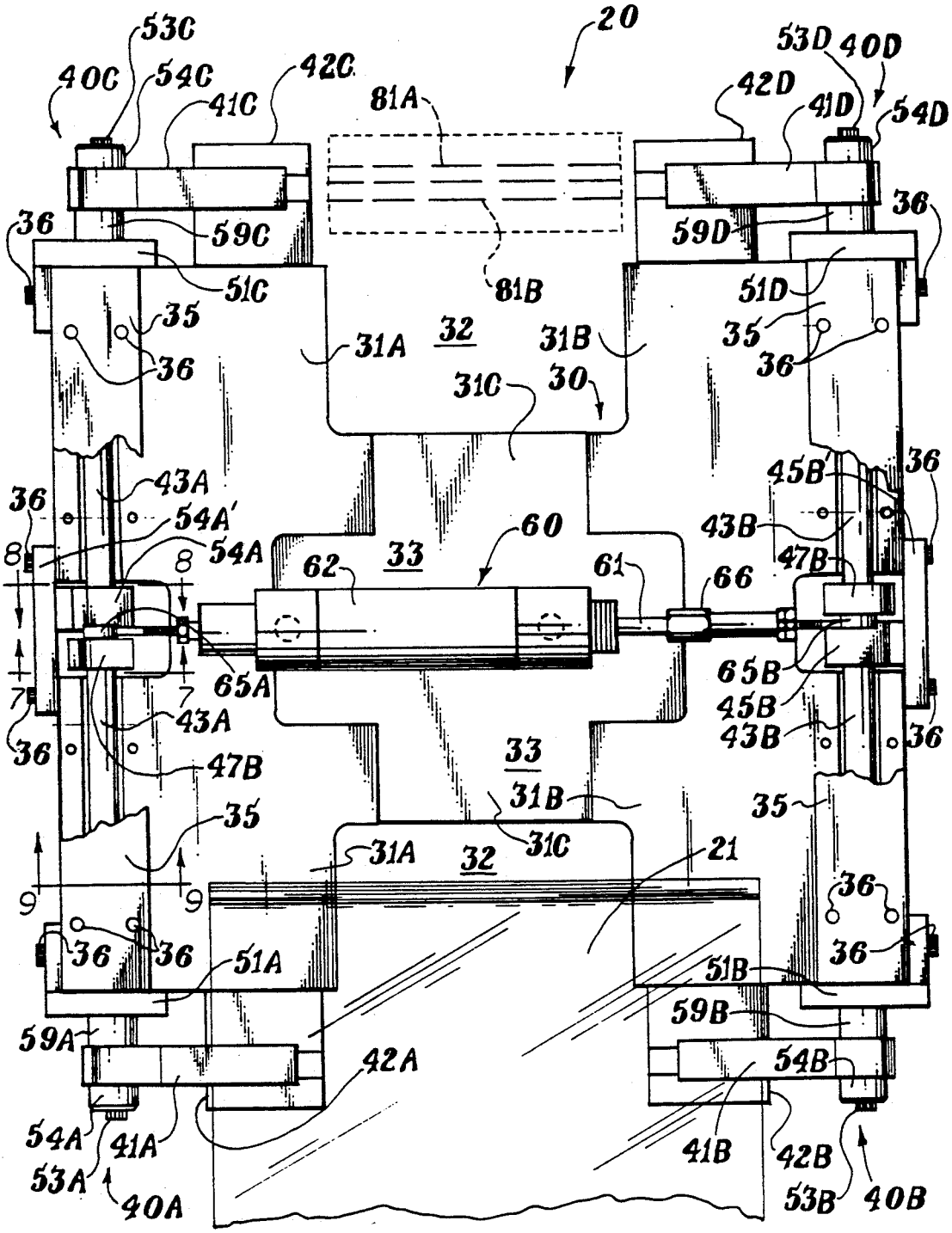
FIG. 2 shows a top view of the apparatus of FIG. 1.

With reference to FIGS. 1 and 2, the base support plate member 30, in this instance, is generally "H-shaped", when viewed from the top of the apparatus, having parallel plate portions 31A and 31B releasably attached to the top of a transverse plate portion 31C, wherein plate portion 31C is releasably attached normal to portions 31A and 31B and generally at the mid-section of portions 31A and 31B. The plate member 30 is, however, not limited to any shape or number of portions. For example, the plate portion 31C can be a rectangular or square flat plate member having a width and length greater, smaller or equal to the width and length of plate portion 31A and 31B. In another embodiment, the H-shaped body of the base plate member 30 can be a one-piece member wherein the plate portions 31A, 31B and 31C are integral with each other in the same horizontal plane or the base plate member 30 can be a one-piece flat plate member of any shape.

However, in the present embodiment as described and illustrated herein, the present invention apparatus preferably comprises three plate portions 31A, 31B, and 31C each having a top and bottom wherein plate portions 31A and 31B are releasably attached to the top of plate portion 31C for ease of assembly and maintenance; and the plate portions 31A and 31B are substantially mirror images of each other and substantially identical to provide for the interchangeability of the apparatus components.

In addition, assembly of plate portions 31A, 31B and 31C provides spaces 32 and indented portions (or wells) 33. Spaces 32 between plates portions 31A and 31B are to provide sufficient clearance for clamping turret members (turret jaws 81A and 81B are shown in phantom lines in FIG. 2) and described in more detail herein below with reference to FIGS. 10 and 11 *a–d*, wherein said clamping turret members interact with the apparatus 20 during its operation. Indented portions 33 provide space for connecting supply and return lines to connections 63 and 64, respectively, of actuator 60; and for allowing the actuator 60 to move freely without restriction or obstructing elements of the apparatus 20.

Figure 9:
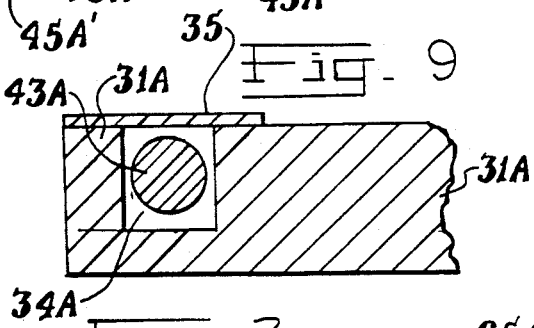
FIG. 9 shows a cross-sectional view of a portion of the apparatus of the present invention taken along line 9—9 in FIG. 2.

Referring to FIGS. 2 and 9, plate portions 31A and 31B contain longitudinal channels 34A and 34B, respectively, normal to portion 31C and actuator 60. The channels 34A and 34B are adapted to receive rods or shafts 43A and 43B, respectively, of clamping assemblies 40A–D. Preferably, the channels 34A and 34B contain cover plates 35 for covering the channels 34A and 34B and shafts 43A and 43B. Cover plates 35 keep dust and other foreign objects out of channels 34A and 34B. The cover plates 35 are releasably attached to plate portions 31A and 31B by either button head cap screws, socket head cap screws or threaded bolts 36. Most elements of the present apparatuses are releasably attached to the base plate 30, for example, by fasteners 36, however, if desired other means of attachment such as welding can be used.

Figure 3:
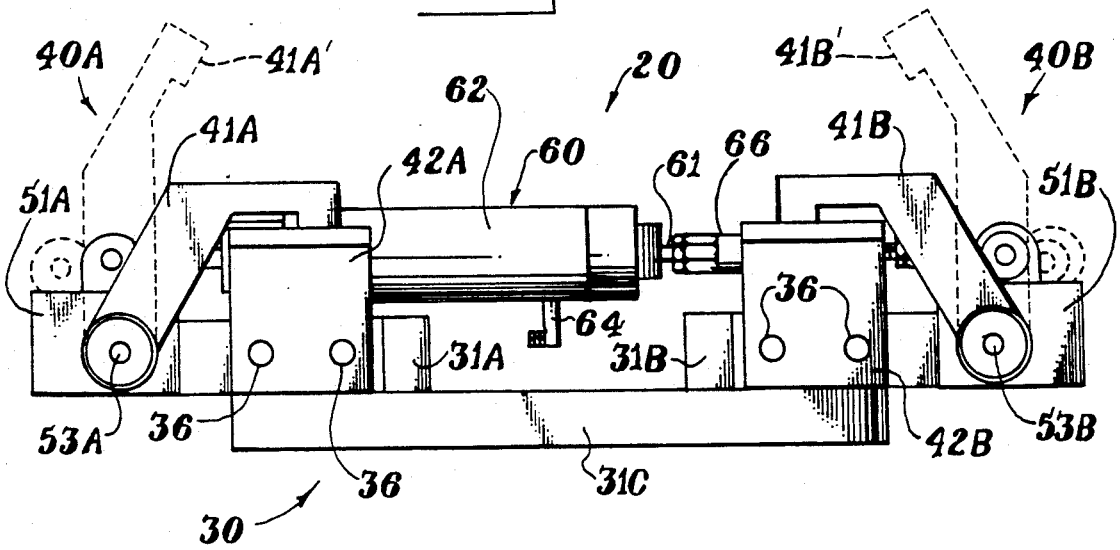
FIG. 3 shows a side view of the apparatus of the present invention taken along line 3—3 in FIG. 1.
Figure 4:
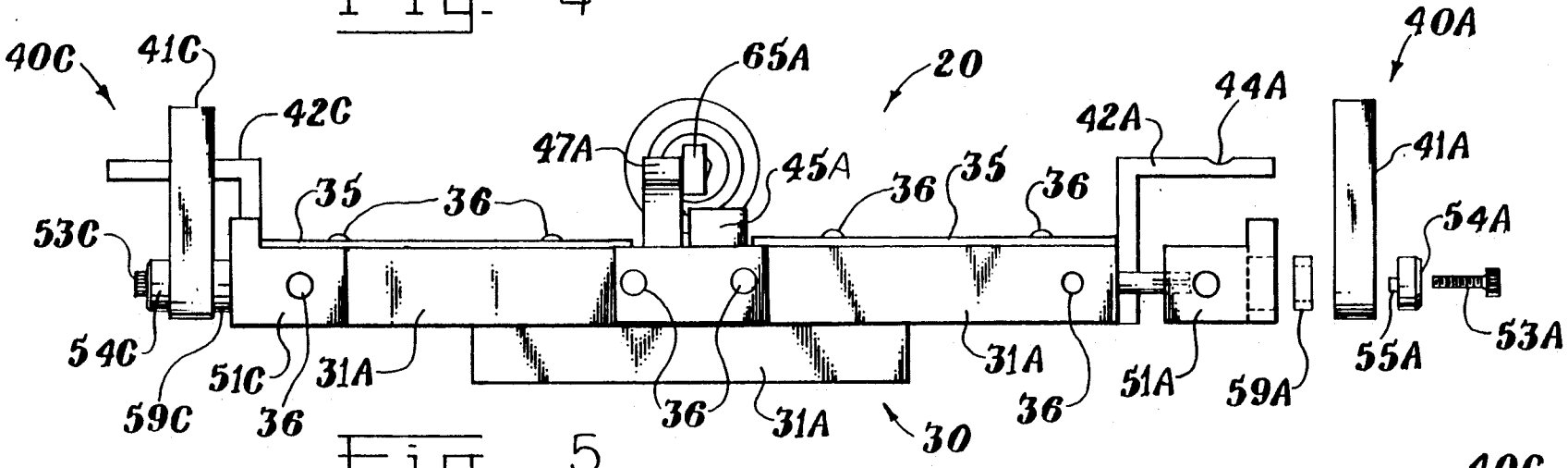
FIG. 4 shows another side view, partly exploded, of the apparatus of the present invention taken along line 4—4 in FIG. 1.
Figure 5:
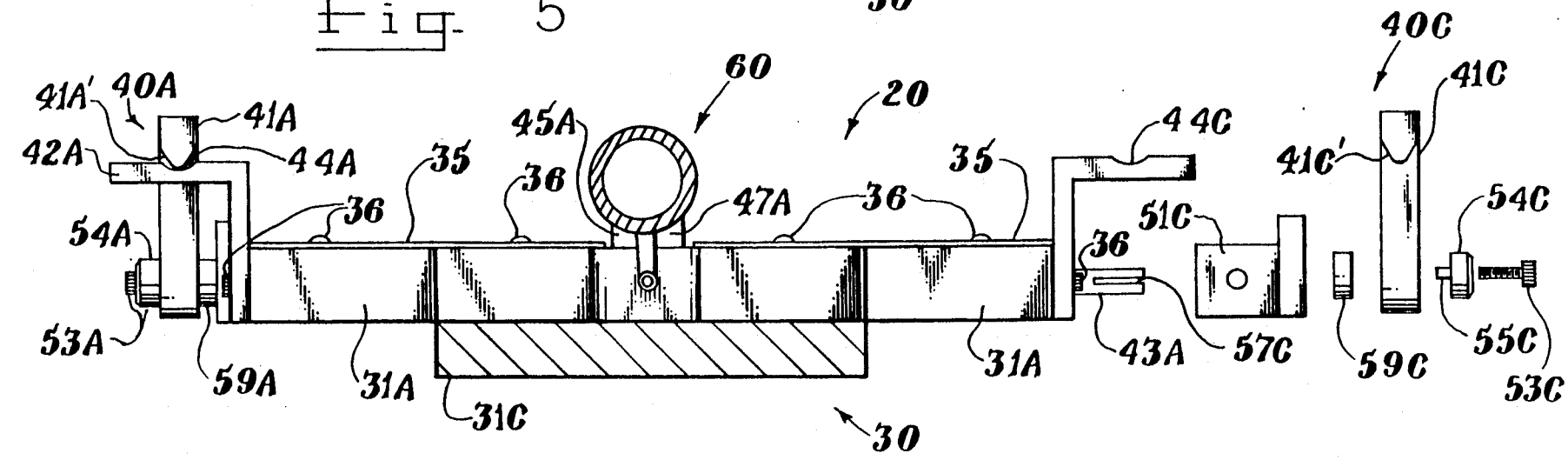
FIG. 5 shows another side view, partly in section and partly exploded, of the apparatus of the present invention taken along line 5—5 in FIG. 1.

The clamping assemblies 40A–D, more clearly shown in FIGS. 3–6, will be described herein with reference to only one-half of the apparatus 20 of the present invention which includes one plate portion 31A of the apparatus 20 and clamping assemblies 40A and 40C, as shown in FIGS. 4 and 5, since plate portion 31B is identical except that plate portion 31B, together with clamping assemblies 40B and 40D, are in a directly opposing position to plate portion 31A and clamping assemblies 40A and 40C, in mirror image.

Clamping assemblies 40A and 40C include a pair of clamping fingers 41A and 41C releasably attached to the ends of a shaft 43A pivotally mounted in the channel 34A; and clamping brackets 42A and 42C, preferably having grooves 44A and 44C, respectively, for receiving the clamping fingers 41A and 41C, more particularly, the grooves 44A and 44C are adapted to receive the raised and beveled portions 41A' and 41C' of fingers 41A and 41C. Fingers 41A and 41C, as well as the other elements of apparatus 20 can be made of any material. Preferably, fingers 41A and 41C can be entirely made of or coated with a material which eliminates marring, scratching, or scuffing or otherwise damages the flexible product being clamped. For example, the finger material or coating may be nylon, polyethylene, polyurethane, other plastics, rubber and the like. Optionally, and more preferably, only the raised or protruded portions 41A' and 41C' of fingers 41A and 41C, which come in direct contact with the flexible products, can be coated or made of such materials instead of the whole fingers 41A and 41C.

It is contemplated that the brackets 42A and 42C can be made adjustable, for example by using a slot and threaded fastener, but preferably, the brackets 42A and 42C are stationary. More preferably, the brackets 42A and 42C of clamping assemblies 40A and 40C are releasably fixed or mounted to the plate member 31A by a fastener, for example with bolts 36.

Figure 6:
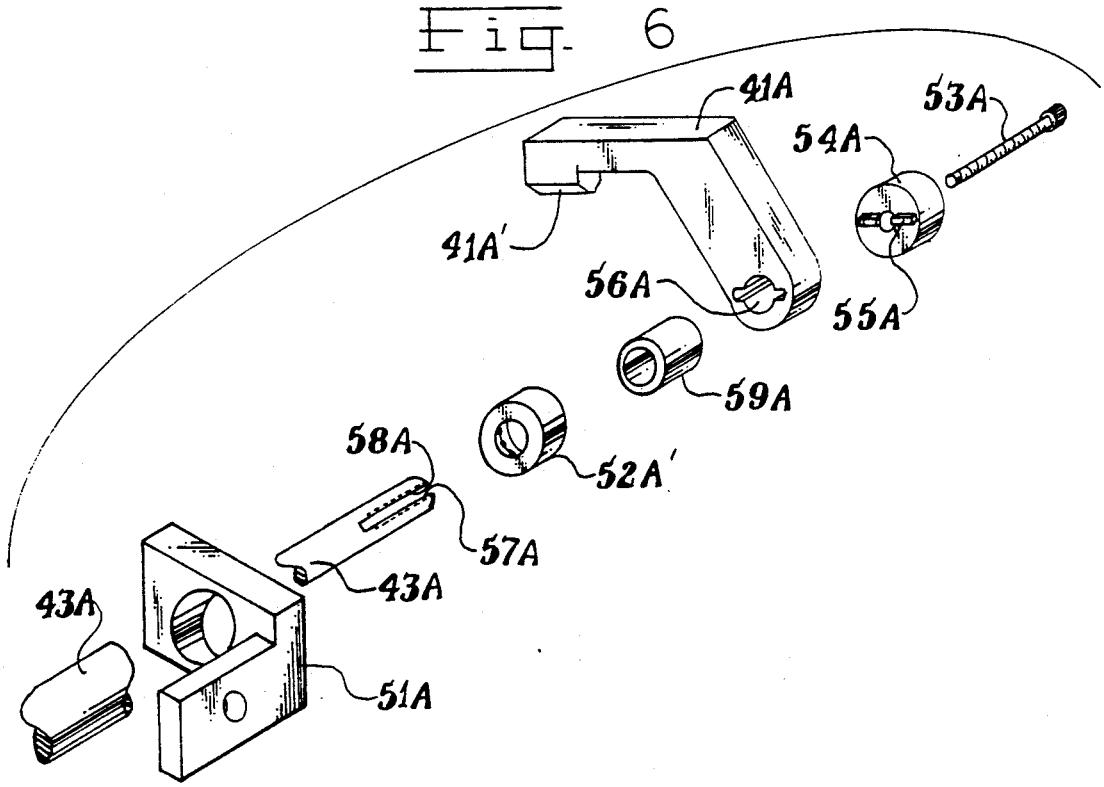
FIG. 6 shows an exploded, perspective view, in part, of the apparatus of FIG. 1.
Figure 8:
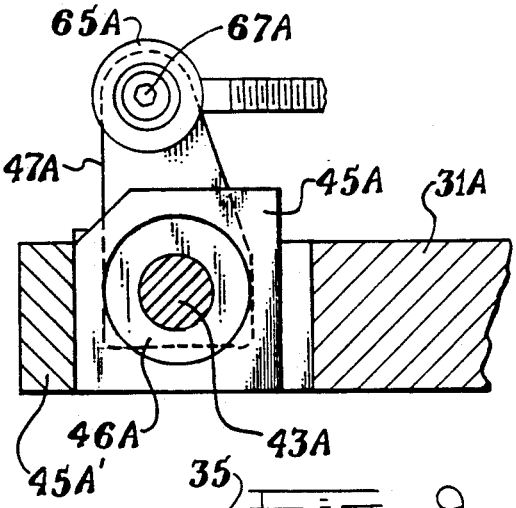
FIG. 8 shows a side view, partly in section, of a portion of the apparatus of the present invention taken along line 8—8 in FIG. 2.
Figure 7:
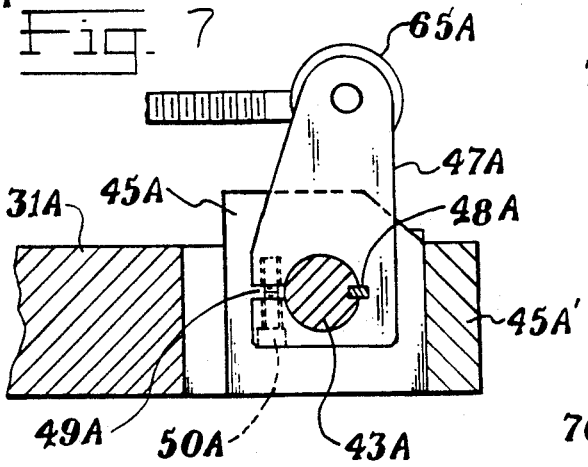
FIG. 7 shows a side view, partly in section, of a portion of the apparatus of the present invention taken along line 7—7 in FIG. 2.
Figure 11A:
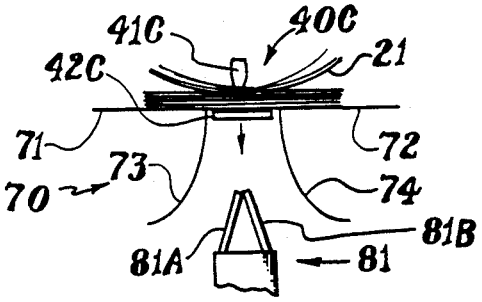
FIGS. 11 *a–d* show a schematic of the sequence of the folding and packaging equipment and process for a stack of flexible products utilizing the apparatus of FIG. 1 which is partly shown.
Figure 11B:
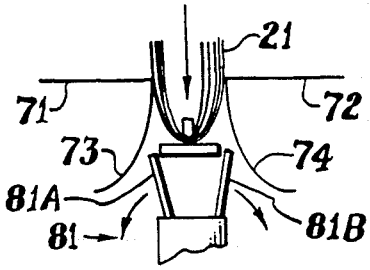
Figure 11C:
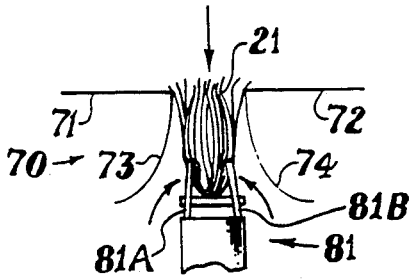
Figure 11D:
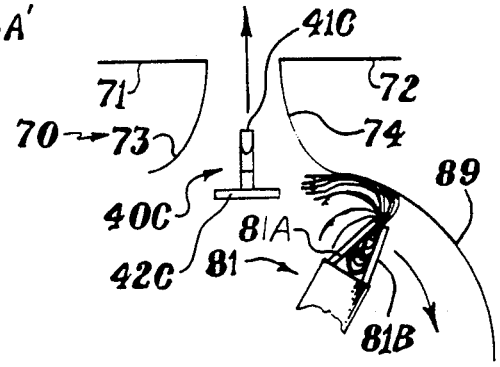

With reference to FIGS. 7 and 8, the clamping assemblies 40A and 40C further comprise a shaft center support bearing housing 45A with a bearing 46A therein and control arm 47A. The control arm 47A is releasably and pivotally attached to shaft 43A and the arm 47A is adapted to pivot upon rotation of the shaft 43A. Control arm 47A is attached to shaft 43A by a slot and key member 48A and the gripping attachment of arm 47A to shaft 43A can be adjusted via a slot 49A and threaded fastener 50A, such as a threaded bolt 50A, by tightening or loosening the fastener 50A. The clamping assemblies 40A and 40C also include shaft end support bearing housings 51A and 51C with bearings 52A and 52C therein (more clearly shown in FIG. 6). The shaft center and end support bearing housings 45A, 51A and 51C are preferably releasably attached to plate member 31A by a fastener such as screws 36.

The finger 41A is releasably attached to the shaft 43A, more clearly shown in FIG. 6, by a threaded fastener such as a threaded screw 53A; and keyed washer 54A having a raised key portion 55A adapted to fit in slotted keyhole portion 56A of finger 41A. The keyed portion 55A also fits into slot 57A in shaft 43A. This embodiment ensures that the fingers 41A and 41C pivot identically and simultaneously the same distance and with the same force when shaft 43A rotates. A threaded portion 58A in shaft 43A is adapted to receive fastener 53A to complete the attachment of finger 41A to shaft 43A. A washer spacing means 59A is preferably used to space the finger 41A from bearing housing 51A and to provide alignment of the finger 41A with groove 44A in the bracket 42A.

Referring now to FIGS. 1, 7 and 8, the actuator 60 is preferably a piston-type assembly comprising a piston shaft 61 and piston body 62. The piston 60 is connected to the clamping assembly by being releasably attached to the control arms 47A and 47B by rod end fasteners 65A and 65B such as Heimjoint TM (Heim Corp.) or Uniball TM (Spherco Co.). The piston shaft 61 is releasably attached to control arm 47B by fastener 65B with shoulder bolt 67B and the piston body 62 is releasably attached to control arm 47A by the rod end fastener 65A with shoulder bolt 67A. The piston 60, preferably, is a pneumatic actuator in the form of a piston 60, although a hydraulic device, electrical device or other known actuators such as a rotary actuator can be used. The piston shaft 61 and piston body 62 of the actuator 60 are actuated, in this instance, with air from an air source (not shown) via air supply and air return nozzles 63 and 64, respectively. The piston 60 can include an adjustment means for the stroke of the piston such as a turnbuckle 66.

As shown in FIG. 3, upon activating the actuator 60, the piston shaft 61 and piston body 62 pull apart applying a force against the pivotal control arm 47A and 47B, respectively, causing the clamping assembly shafts 43A and 43B to restrictively (partly) rotate a predetermined amount of degrees to, in turn, cause the clamping fingers 41A and 41B to pivot outwardly away from clamping brackets 42A and 42B coming to rest in an "open position" with respect to the clamping brackets 42A and 42B. The arms 47A and 47B pivot toward and bias against backstop portions 45A' and 45B' (shown in FIGS. 7 and 8) which are integral to bearing housing 45A and 45B, respectively. The backstop portions 45A' and 45B' restrain the pivot action of arms 47A and 47B, i.e., the backstop portions 45A' and 45B' limit how wide the "opening" of the fingers 41A and 41B can be. If desired, an adjusting means (not shown) such as a threaded bolt or screw-type adjustment means, can be placed in the backstop portions 45A' and 45B' to adjust the amount of pivoting action of arms 47A and 47B. When the actuator 60 is activated to push together the shaft 61 and body 62, the shaft 43A rotates a sufficient amount to cause the clamp fingers 41A and 41B to pivot inwardly towards the clamping bracket 42A and 42B coming to rest in a "closed position" against the stationary clamp brackets 42A and 42B.

The clamping assemblies 40A–D of the present invention provide a simultaneous clamping action from the first pair of clamping fingers 41A and 41B and the second pair of clamping fingers 41C and 41D. The present invention advantageously eliminates the need to attach a separate actuator to each clamping finger as done in the prior art devices. The present invention provides less moving parts and ensures simultaneous as well as equal force application to a stack of flexible products.

In operation, the entire apparatus 20 is attached, for example by welding or bolting the plate portion 31C, to an elevator means (not shown) which moves the apparatus 20 in vertical alignment, up and down, from one elevation to another. Starting in a down position, the apparatus 20 is moved up to a predetermined height and position for receiving a stack of flexible products such as a stack of plastic bags 21 (shown in FIG. 10). After the stack of bags 21 are positioned on top of the stationary clamping brackets 42A and 42B with the finger members 41A and 41B in an open position, the clamping fingers 41A and 41B are then closed to clamp the bags against the grooves 44A and 44B which provides a slight preliminary fold to the bags at the bags center axis.

The apparatus 20 having the clamped stack of bags 21 is then transferred vertically down to a second position for further handling. For example, the clamped stack of bags 21 from apparatus 20 is preferably further processed through conventional folding and packaging equipment, such as a folding mechanism 70 and turret assembly 80 described herein below.

Figure 10:
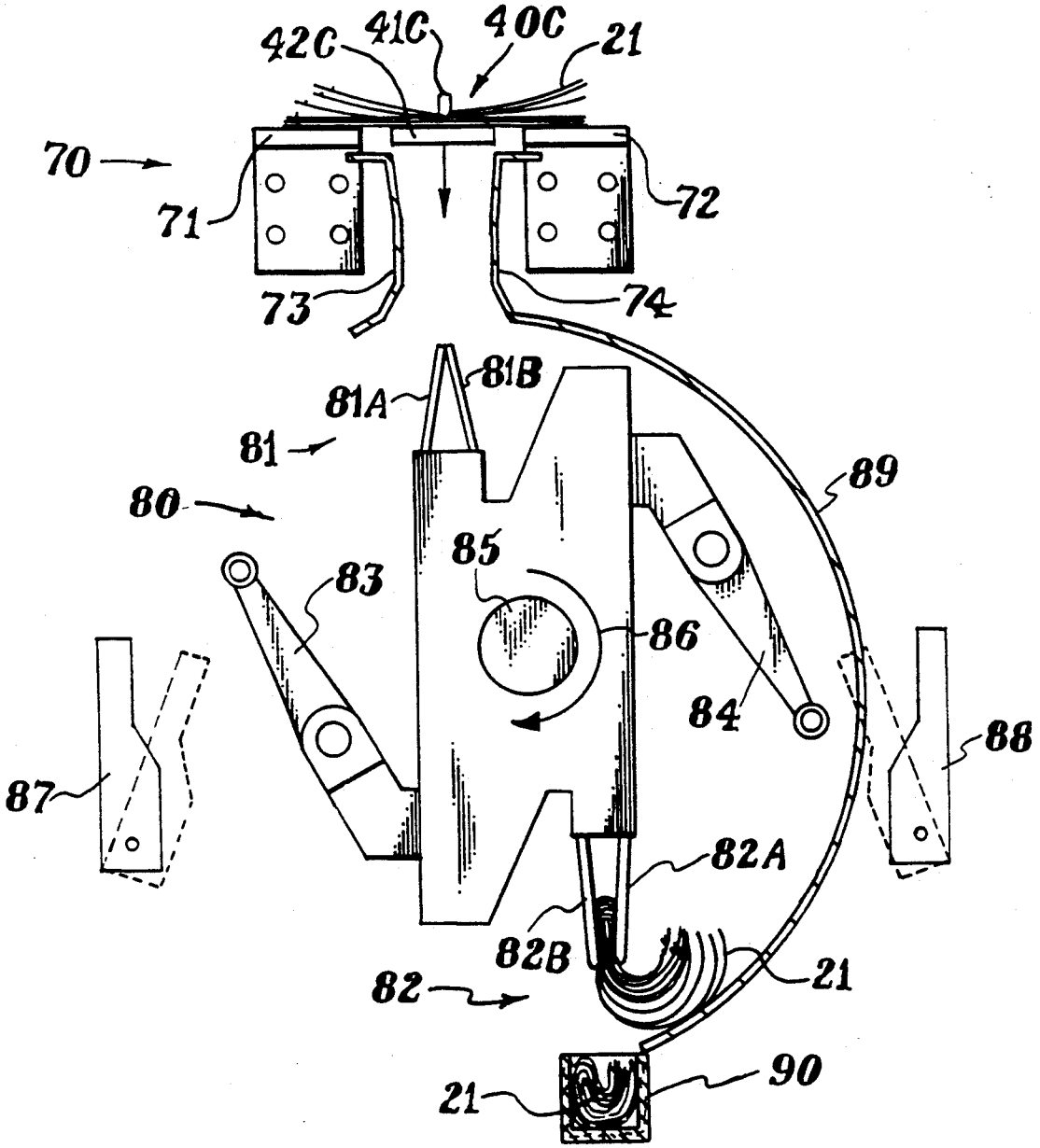
FIG. 10 shows a schematic of the folding and packaging equipment for a stack of flexible products utilizing the apparatus of FIG. 1 which is partly shown.

In FIGS. 10 and 11 *a–d*, the apparatus 20 is partly shown (only part of the apparatus 20 with one clamping finger 41C and bracket 42C is shown). With reference to FIGS. 10 and 11 *a–d*, there is shown the apparatus 20 with a clamped stack of bags 21 which travels through a first folding mechanism, generally indicated by numeral 70, as the apparatus 20 is moved vertically downward. The first folding mechanism 70 includes a pair of support platforms 71 and 72 and a pair of guides 73 and 74. From the pair of support platforms 71 and 72, the clamped stack of bags 21 travels through the "throat means" comprising side walls or guides 73 and 74, wherein bags 21 are folded substantially in half, at the centerline of the bags, forming a "U-shaped" stack when viewed at one side of the stack (shown in FIGS. 11*a* and 11*b*). The bags 21 are maintained in the first fold position until a turret assembly 80 rotates a turret clamp 81 having a pair of jaws 81A and 81B in an open arrangement, to a position just below the folded bags 21 (shown in FIG. 11*b*).

Referring to FIG. 10, generally, the turret assembly 80 includes a pair of turret clamps 81 and 82, and arms 83 and 84 rotating on a shaft 85 in a direction indicated by arrow 86. The turret assembly 80 further includes actuating arms 87 and 88 for actuating the opening and closing of the jaw members of clamps 81 and 82. At the base of the fold, i.e., at the bottom of the "U" of the folded bags 21, the turret clamp 81 of the turret assembly 80 clamps the stack of folded bags with jaws 81A and 81B (shown in FIG. 11*c*). The jaws 81A and 81B of clamp 81 and jaws 82A and 82B of clamp 82 are normally closed and are actuated open by actuator arm 87 or 88, respectively, which pivot and contact turret assembly arms 83 and 84 at the appropriate time and sequence. As the jaws 81A and 81B clamp the bags 21, the clamping finger 41C opens and releases the stack of bags from apparatus 20. As the turret assembly 80 rotates (as indicated by directional arrow 86) the bags 21 contact a folding guide or shroud 89 (shown in FIG. 11*d*) which incorporates a second fold into the bags 21 as the bags leave or exit the end of the shroud 89. As the turret assembly arm 84 contacts the actuator arm member 88, the clamping member 82 is pushed down into a dispenser 90 and the jaws 82A and 82B of clamping member 82 open, releasing the folded bags 21 to load the folded bags into the dispenser 90. The turret clamp 81 eventually rotates 360 degrees to the point where the clamp 81 receives another set of bags transferred from the apparatus 20 ending one complete cycle for the turret assembly clamp 81. The dispenser 90 is then transferred to closing and packaging equipment, conventionally known, for further handling.

The present invention has been described above with reference to specific embodiments and details for purposes of illustrating the invention only. It will be apparent to those skilled in the art that various changes in the methods and apparatus disclosed herein may be made without departing from the scope of the present invention, which is defined in the appended claims.

What is claimed is:

1. A process for sequential handling of a stack of flexible products comprising:
   (a) removing individual flexible products from a transfer drum;
   (b) stacking said individual flexible products at a transfer point;
   (c) delivering said stack of flexible products to an apparatus for transferring stacks of flexible products between at least two geometric planes comprising a base support structure having a top and bottom; at least one pair of oppositely positioned clamping means releasably attached to the top of the support structure for clamping a first stack of flexible products wherein each clamping means comprises a shaft member, at least one finger member releasably attached to the shaft member, and a stationary bracket releasably attached to the support structure; and a single actuating means for substantially simultaneously actuating the at least one pair of clamping means, said actuating means releasably attached substantially perpendicularly to the shaft member of each clamping means;
   (d) transferring the stack of flexible products to a folding means;
   (e) folding said stack of flexible products; and
   (f) packaging the folded stack of flexible products.

2. An apparatus for transferring flexible products between at least two geometric planes comprising a base support structure; at least one pair of oppositely positioned clamping means releasably attached to the support structure wherein each clamping means comprises a shaft member, at least one finger member releasably attached to the shaft member, and a stationary bracket releasably attached to the support structure; and a single actuating means for actuating said at least one pair of clamping means, said actuating means releasably attached substantially perpendicularly to the shaft member of each clamping means.

3. The apparatus of claim 2 comprising a flat plate base support structure having a top and bottom; at least a first pair of clamping means releasably attached to the top of the support structure for clamping a first stack of flexible products; and an actuating means releasably attached to said first pair of clamping means; said actuating means adapted for substantially simultaneously actuating the at least first pair of clamping means.

4. The apparatus of claim 3 including a second pair of clamping means releasably attached to the top of the support structure for clamping a second stack of flexible products and said actuating means releasably attached to said first and second pair of clamping means such that when said actuating means is activated said first and second pair of clamping means are substantially simultaneously actuated for clamping substantially simultaneously said first and second stacks of flexible products.

5. The apparatus of claim 2 wherein the actuating means is a pneumatic piston.

6. The apparatus of claim 2 wherein the flexible products are zipper-type plastic bags.

7. The apparatus of claim 5 wherein the piston includes an adjustment means for controlling the stroke length of the piston.

8. The apparatus of claim 2 wherein the actuating means is attached to a pivot arm which is attached to each shaft member.

9. The apparatus of claim 2 wherein the bracket contains a groove for providing a preliminary fold in said stack of flexible products.

10. An apparatus for transferring stacks of flexible products comprising a base support structure; at least one pair of clamping means attached to said support structure wherein each clamping means comprises a shaft member, at least one finger member releasably attached to the shaft member wherein the finger member is coated with a material for preventing damage to the flexible products, and a stationary bracket releasably attached to the support structure; and a single actuating means for actuating said at least one pair of clamping means wherein the actuating means is attached to the shaft member of said at least one pair of clamping means.

11. A folding and packaging assembly for flexible products comprising:

(a) means for delivering a stack of flexible products to an apparatus for transferring stacks of flexible products;

(b) an apparatus for transferring stacks of flexible products between at least two geometric planes comprising a base support structure having a top and bottom; at least one pair of oppositely positioned clamping means releasably attached to the top of the support structure for clamping a first stack of flexible products wherein each clamping means comprises a shaft member, at least one finger member releasably attached to the shaft member, and a stationary bracket releasably attached to the support structure; and a single actuating means for actuating the at least one pair of clamping means, said actuating means releasably attached substantially perpendicularly to the shaft member of each clamping means;

(c) means for transferring the apparatus of (b) with the stack of flexible products to a folding means;

(d) a folding means for folding said stack of flexible products; and (e) means for packaging the folded stack of flexible products.

12. A folding and packaging assembly for flexible products comprising:

(a) means for delivering a stack of flexible products to an apparatus for transferring stacks of flexible products;

(b) an apparatus for transferring stacks of flexible products comprising a base support structure having a top and bottom; at least one pair of clamping means releasably attached to the top of the support structure for clamping a first stack of flexible products wherein each clamping means comprises a shaft member, at least one finger member releasably attached to the shaft member, and a stationary bracket releasably attached to the support structure; and a single actuating means for substantially simultaneously actuating the at least one pair of clamping means, said actuating means releasably attached to the shaft member of each clamping means;

(c) means for transferring the apparatus of (b) with the stack of flexible products to a folding means wherein the means for transferring the apparatus (b) includes an elevating means for moving the apparatus vertically up and down;

(d) a folding means for folding said stack of flexible products; and (e) means for packaging the folded stack of flexible products.

13. A bag sealer apparatus comprising (a) a rotary drum for producing individual flexible products;

(b) a transfer drum for transferring the individual flexible products to a transfer point;

(c) means for removing individual flexible products from the transfer drum;

(d) means for stacking said individual flexible products at a transfer point;

(e) means for delivering said stack of flexible products from said transfer point to an apparatus for transferring stacks of flexible products;

(f) an apparatus for transferring stacks of flexible products between at least two geometric planes comprising a base support structure having a top and bottom; at least one pair of oppositely positioned clamping means releasably attached to the top of the support structure for clamping a first stack of flexible products wherein each clamping means comprises a shaft member, at least one finger member releasably attached to the shaft member, and a stationary bracket releasably attached to the support structure; and a single actuating means for substantially simultaneously actuating the at least one pair of clamping means, said actuating means releasably attached substantially perpendicularly to the shaft member of each clamping means;

(g) means for transferring the stack of flexible products to a folding means;

(h) a folding means; and (i) means for packaging the folded stack of flexible products.

14. An apparatus for transferring stacks of flexible products comprising a base support structure, at least one pair of clamping means attached to said base support structure, and a single actuating means for actuating said at least one pair of clamping means wherein the base support structure is H-shaped.

* * * * *